US006217345B1

(12) United States Patent
Murakami et al.

(10) Patent No.: US 6,217,345 B1
(45) Date of Patent: Apr. 17, 2001

(54) ELECTRICAL CONNECTOR

(75) Inventors: Takao Murakami; Masaya Yamamoto, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/280,706

(22) Filed: Mar. 30, 1999

(30) Foreign Application Priority Data

Mar. 31, 1998 (JP) ..... 10-087545

(51) Int. Cl.[7] ..... H01R 9/09
(52) U.S. Cl. ..... 439/77; 439/382
(58) Field of Search ..... 439/77, 382, 370, 439/357, 350

(56) References Cited

U.S. PATENT DOCUMENTS 3,417,362 * 12/1968 Reynolds ..... 439/77

FOREIGN PATENT DOCUMENTS 50-63593 6/1975 (JP) .
52-72065 5/1977 (JP) .
53-163582 12/1978 (JP) .

* cited by examiner

*Primary Examiner*—Lincoln Donovan
*Assistant Examiner*—Thanh-Tam Le
(74) *Attorney, Agent, or Firm*—Armstrong, Westerman, Hattori, McLeland & Naughton, LLP

(57) ABSTRACT

A connector has a connector housing, a plurality of terminals, an assisting means, and a support means. The connector housing can be received in a connector receiving recess having a first wall fitted with a plurality of terminal connecting short strips. The connector housing has a plurality of terminal accommodating chambers with at least an opening communicating with the first wall side of the connector receiving recess. Furthermore, each terminal has a wire connection portion and an elastic contact piece extending from the wire connection portion. The elastic contact piece is defined by folding back a forward part of the terminal toward the wire connection portion. The folded-back portion has a contact portion formed in the middle thereof to contact the terminal connecting short strip through the opening. A plurality of terminals are inserted into the terminal accommodating chambers of the connector housing. Meanwhile, the assisting means can resiliently abut against a second wall opposing to the first wall in respect of the connector receiving recess, which urges additionally the elastic contact piece against the terminal connecting short strip. The support means engages with the assisting means to hold it.

5 Claims, 5 Drawing Sheets

ELECTRICAL CONNECTOR

BACKGROUND OF THE INVENTION

1. Field of the Invention

The present invention relates to an electrical connector, more particularly to a connector inserted into a connector receiving recess fitted with a flexible print-circuit having a plurality of terminal connecting short strips. The connector also has a plurality of terminals each formed with an elastic contact piece for contracting one of the terminal connecting short strips through an opening of a terminal accommodating chamber of the connector.

2. Prior Art

A typical one of such connectors is shown in FIG. 8, which is known generally.

FIG. 8 shows a connector 1 having a rectangular connector housing 2 provided with a plurality of terminal accommodating chambers 3 (only one chamber is illustrated in FIG. 8) each of which receives a terminal 5 having an elastic contact piece 4. The connector is inserted in a connector receiving recess 7 fitted with a flexible print-circuit (called as FPC hereinafter) 6.

The plurality of terminal accommodating chambers 3 each have an opening 8 defined in a wall thereof to be opposed to FPC 6 of the connector receiving recess 7. The elastic contact piece 4 is constructed to project by a given distance from the opening 8. In addition, the plurality of terminal accommodating chambers 3 each have the opening at the rear end thereof for inserting a terminal 5 into the terminal accommodating chamber 3.

The terminal 5 is made of an electrical conductive metal and has both an elastic contact piece 4 and a wire connection portion 11 that crimps an electrical wire 10. The elastic contact piece 4 has a contact portion 12 in the middle of a folded-back forward part thereof. The elastic contact piece 4 is projecting from the opening 8 toward the wire connection portion 11.

The connector receiving recess 7 is defined in an instrument case 13 so as to receive the connector housing 2. FPC 6 arranged in the connector receiving recess 7 has a plurality of terminal connecting short strips (not shown) each connecting with the contact portion 12 of one of the terminals 5.

When the connector receiving recess 7 receives the connector 1, each elastic contact piece 4 deflects resiliently and abuts against the terminal connecting short strip (not shown) for electrical contact thereof with a suitable contact force.

Now, an object of the invention will be discussed hereinafter.

In the aforementioned prior art, as shown in FIG. 8, there may be variations in distance A between the opposite walls of the connector receiving recess 7, in distance B between FPC 6 and the second wall, and in an original height C from a bottom wall of the connector housing 2 to the contact portion 12. Thus, a deflection allowance D of the elastic contact piece 4 is not defined reliably, causing disadvantageously an unreliable contact force between the elastic contact piece 4 and the terminal connecting short strip.

In addition, since the instrument case 13, of which the connector receiving recess 7 and the connector housing 2 are made of synthetic resin, is influenced by a surrounding high temperature, the distances A, B of the connector receiving recess 7 vary in a larger range so that the elastic contact piece 4 may have an undesirable smaller contact force.

Meanwhile, the elastic contact piece 4 is limited in width, thickness, and deflection since it must be located in the terminal accommodating chamber 3 in relation to the connector receiving recess 7. Moreover, the elastic contact piece 4 is limited in material due to electric conductivity.

Furthermore, when the elastic contact piece 4 has a comparatively large elastic coefficient, the contact force varies in a lager range corresponding to the deflection of the elastic contact piece 4. Thus, a small variation of the dimensions A, C may cause a comparatively large variation of the contact force of the elastic contact piece 4, which may make the elastic contact piece 4 yield with time. Accordingly, as mentioned above, the elastic contact piece 4 provides an unsteady contact force against the terminal connecting short strip.

SUMMARY OF THE INVENTION

In order to eliminate such disadvantages, an object of the present invention is to provide a connector having an elastic contact piece that provides a steady contact force against a terminal connecting short strip of a connector receiving recess.

For achieving the object, in a first configuration according to the present invention, an electrical connector includes a connector housing, a plurality of terminals, an assisting means, and a support means. The connector housing can be received in a connector receiving recess having a first wall fitted with a plurality of terminal connecting short strips. The connector housing has a plurality of terminal accommodating chambers with openings through which the plurality of terminal accommodating chambers communicate with the first wall side of the connector receiving recess. Furthermore, each terminal has a wire connection portion and an elastic contact piece extending from the wire connection portion. The elastic contact piece is defined by folding back a forward part of the terminal toward the wire connection portion. The folded-back portion has a contact portion formed at the middle part thereof to contact the terminal connecting short strip through the opening. The plurality of terminals are inserted in the terminal accommodating chambers of the connector housing. Meanwhile, the assisting means can resiliently abut against a second wall opposing to the first wall in respect of the connector receiving recess, which urges additionally the elastic contact piece against the terminal connecting short strip. The support means formed in the connector housing is engaged with the assisting means to hold it.

When thus configured connector is inserted into the connector receiving recess, the elastic contact piece abuts against the terminal connecting short strip to resiliently deflect to make electrical connection thereof with a suitable contact force while the assisting means resiliently abuts against the second wall of the connector receiving recess, even if there are variations in the distance between the first and second walls of the connector receiving recess and in the connector height that is the height of the contact portion of the elastic contact piece, and even when the elastic contact piece has yielded with time. The assisting means can act to keep a suitable contact force between the contact portion and the terminal connecting short strip.

This, as discussed above, allows a steady contact force of the elastic contact piece against the terminal connecting short strip of the connector receiving recess, providing a reliable electrical connector.

In a second configuration of the present invention, which is dependent on the electrical connector described in the first configuration, the assisting means is a spring member made of a metal wire rod to have a coiled portion and a couple of arms. The coiled portion is defined by coiling an intermediate portion of the metal wire rod to be engageable with the support means. One of the arms has a reaction portion abutting against the second wall of the connector receiving recess.

Thus, in regard to the assisting means consisting of the spring member including the coiled portion and the couple of the arms, when the reaction portion resiliently abuts against the second wall of the connector receiving recess, the couple of arms resiliently deflect against the wall to pivot around the coiled portion toward each other. Thus, even if there are the variations in size as mentioned above, the assisting means always serves additionally to provide a steady contact force to the elastic contact piece. Moreover, the assisting means requiring no electrical conductivity may be made of a more durable wire rod having a higher allowable stress and a higher yield stress like a piano wire.

Accordingly, the assisting mean consisting of the spring member allows a connector having a high reliability. Advantageously, the spring member can be easily formed.

In a third configuration of the present invention, which is dependent on the electrical connector described in the second configuration, the support means has a supporting shaft receiving the coiled portion and a couple of arm stoppers corresponding to the couple of arms.

The support means and such configured arms can provide a resilient force around the coiled portion.

Thus, the arms held by the arm stoppers can provide an additional resilient force to the elastic contact piece, and also the location of the arm stoppers can adjust the additional force.

The support means simple in design is easily assembled into the connector housing with a comparatively lower cost.

In a fourth configuration of the present invention, which is dependent on the electrical connector described in the first configuration, the assisting means is a spring member made of the metal wire rod and has a pair of coiled portions, a cross over arm, and a pair of arms. Each coiled portion is defined by coiling an intermediate portion of the metal wire rod so as to engage with the support means. The coiled portions are positioned to oppose to each other. The pair of arms each extend from the coiled portion so as to oppose to one another. The cross over arm connects to both the pair of coiled portions and has a reaction portion for abutting against the second wall of the connector receiving recess.

In the assisting means consisting of the spring member having the coiled portions, the cross over arm, and the pair of arms, the pair of arms and the cross over arm resiliently deflect inwardly around the coiled portion. Meanwhile, the reaction portion resiliently abuts against the second wall of the connector receiving recess. Thus, even if there are such variations in size as mentioned above, the assisting means always acts to provide a steady contact force on the elastic contact piece. Moreover, the assisting means requiring no electrical conductivity may be made of a more durable wire rod having a higher allowable stress and a higher yield stress like a piano wire. Thus, the spring member composing the assisting means allows a connector having a high reliability. Advantageously, the spring member can be easily formed.

In a fifth configuration of the present invention, which is dependent on the electrical connector described in the fourth configuration, the reaction portion of the cross over arm has a projection facing toward the second wall of the connector receiving recess, which can effectively receive a reaction force acted on the spring.

In a sixth configuration of the present invention, which is dependent on the electrical connector described in the fourth configuration, the support means has a pair of supporting shafts engageable with the couple of coiled portions, two arm stoppers respectively corresponding to the first and second opposite arms, and a cross over arm stopper corresponding to the cross over arm. The pair of arms and the cross over arm can provide a resilient force in cooperation with the coiled portions.

Furthermore, the location of the arm stoppers and the cross over arm stopper allows adjustment of the additional force of the spring member to assist the elastic contact piece as cooperated with the arm stoppers and the cross over arm stopper.

The support means simple in design is easily assembled in to the connector housing with a comparatively lower cost.

DETAILED DESCRIPTION OF PREFERRED EMBODIMENTS

Referring to the accompanied drawings, embodiments of the present invention will be discussed hereinafter.

Figure 1:
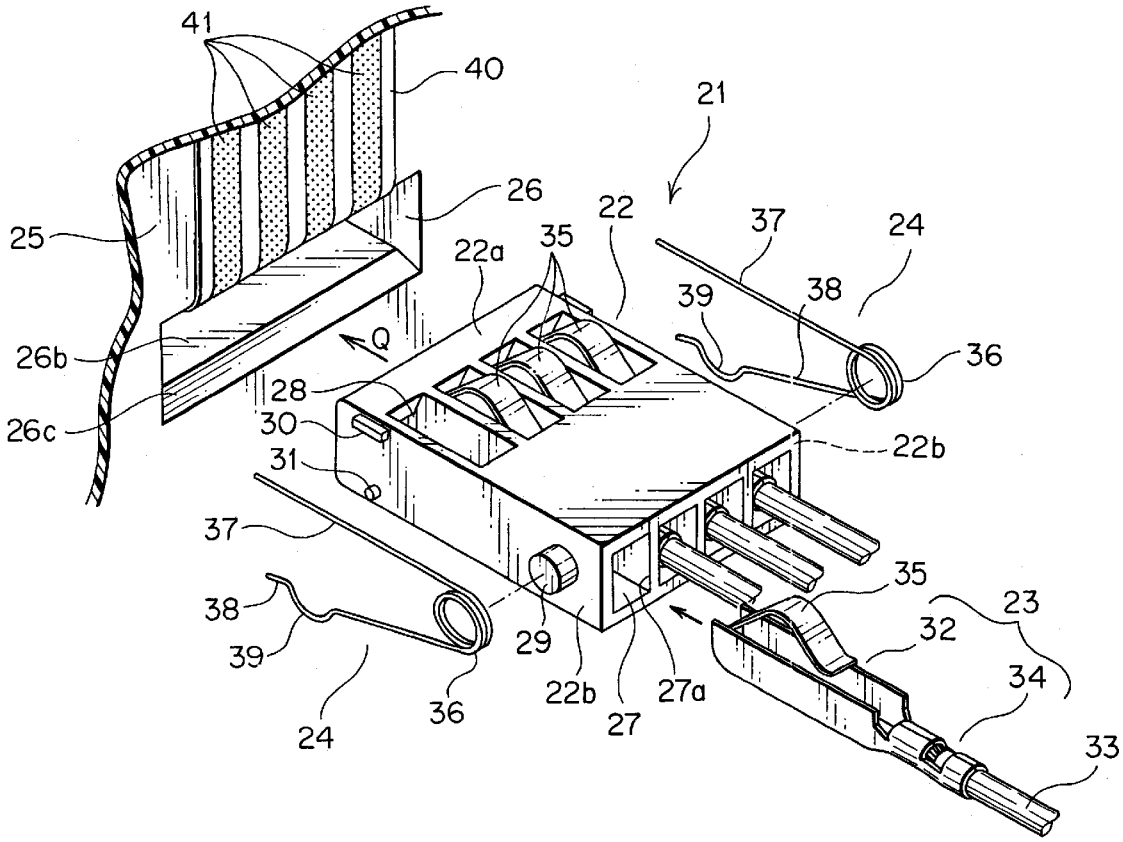
FIG. 1 is an exploded perspective view showing a connector of an embodiment according to the present invention.

Referring to FIG. 1, denoted 21 is a connector. The connector 21 has a connector housing 22 made of synthetic resin, a plurality of terminals 23 accommodated in the connector housing 22 (four terminals are illustrated in this embodiment as an example), and a pair of spring members 24, 24 (corresponding to the assisting means described in the summary of the invention) supported by the connector housing 22. The connector 21, for example, will be inserted into a connector receiving recess 26 formed in an instrument case 25 of an automotive vehicle for electrical connection thereof.

The connector housing 22 has been formed by injection molding or the like and has four terminal accommodating chambers 27 therein. Each terminal accommodating chamber 27 has a conventional terminal locking means such as a lance (not shown). The connector receiving recess 26 has an upper wall 26*a* (see FIG. 2) which communicates with each terminal accommodating chamber 27 through four rectangular openings 28 defined in a top wall 22*a* of the connector housing 22.

The connector housing 22 has side walls 22*b*, 22*b*, which have a pair of column-shaped supporting shafts 29, 29 (corresponding to the support means described in the summary of the invention, and only one shaft is illustrated) at the rear side thereof. That is, the supporting shafts 29, 29 are laterally extending and located in the side of openings 27*a* of the terminal accommodating chambers 27. The side walls 22*b*, 22*b* also each have a rib-like first arm stopper 30 and a column-shaped second arm stopper 31 at the fore end side thereof. The first and second arm stoppers 30, 31

(corresponding to the support means described in the summary of the invention and only one side stoppers are illustrated) are formed on each side wall 22*b* to align with opposite side ones.

The terminal 23 is stamped out from an electrically conductive metal and formed by bending. The terminal 23 has an elastic contact piece 32 and a wire connection portion 34 connected to an electrical wire 33 by crimping. The elastic contact piece 32 has a folded-back portion defined by folding back a forward extending part of the contact piece 32 toward the wire connection portion 34. In the middle of the folded-back portion is formed a raised contact portion 35 which can contact one of terminal connecting short strips 41 (described later) of a connector receiving recess 26 through one of the openings 28.

Each of the spring members 24, 24 is made of a metal wire rod to have a coiled portion 36 with an inside diameter engaging with the supporting shaft 29 at a middle thereof. From each end of the coiled portion 36 there are extending each of a first arm 37 and a second arm 38. The first arm 37 and the second arm 38 are divergently resiliently opposed to each other by way of the coiled portion 36. The second arm 38 has a reaction portion 39 at a forward portion thereof. The reaction portion 39 is formed so as to project downwardly from a bottom wall 22*c* (see FIG. 2) of the connector housing 22 when assembled in the connector housing 22.

Figure 2:
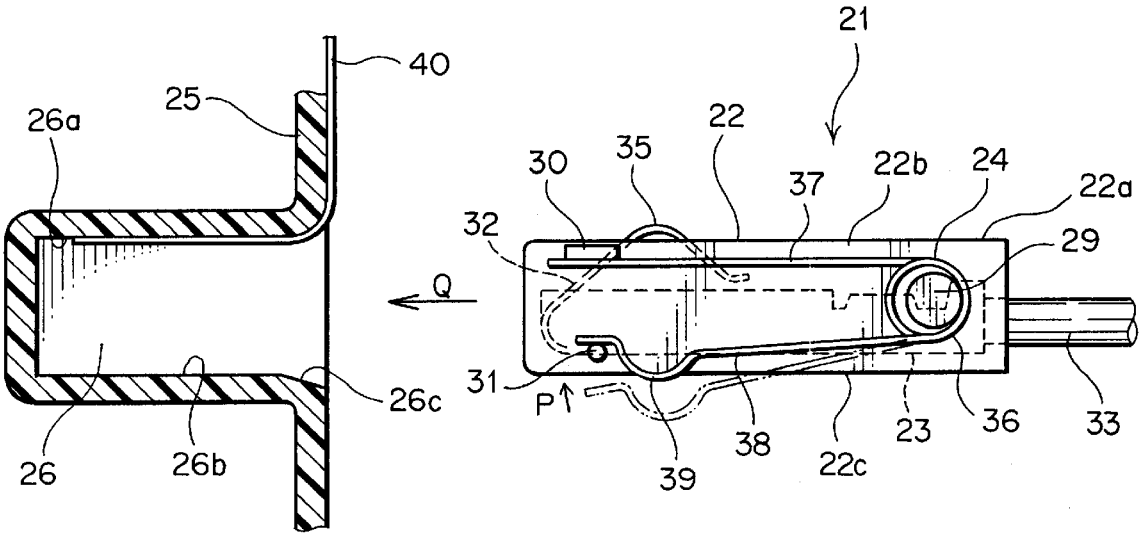
FIG. 2 is a side view of the connector shown in FIG. 1.

Meanwhile, the connector receiving recess 26, as shown in FIGS. 1, 2, has an upper wall 26*a* corresponding to the top wall 22*a* of the connector housing 22 and fitted with a flexible print-circuit (called as FPC hereinafter) 40 along a surface of an instrument case 25 to be secured thereto by bonding or the like. A lower wall 26*b* opposed to the upper wall 26*a* has a tapered portion 26*c* at the connector receiving side thereof for guiding the reaction portions 39, 39.

FPC 40 is a conventional circuit which will not be discussed in detail herein. FPC 40 has a plurality (four in the embodiment) of terminal connecting short strips 41 each arranged to electrically contact one of the elastic contact pieces 32.

Alternatively, FPC 40 may be replaced by an electrical wiring board having terminal connecting pieces.

Figure 3:
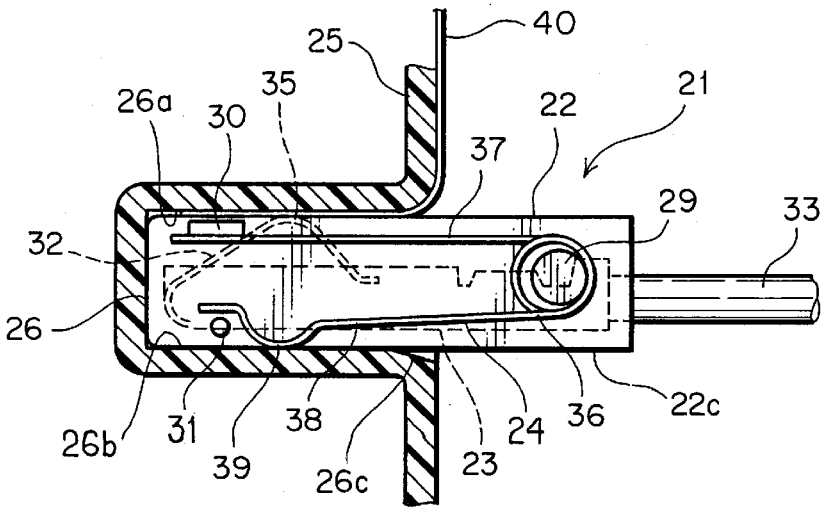
FIG. 3 is a side view showing a state that the connector of FIG. 1 has been inserted in the connector receiving recess.

Next, referring to FIGS. 1 to 3, an assembling step of the connector 21 and an insertion step of the same to the connector receiving recess 26 will be discussed.

As shown in FIG. 1, first, each terminal accommodating chamber 27 of the connector housing 22 receives one of the terminals 23. Each received terminal 23 is locked by a terminal locking means (not shown) and the contact portion 35 of the elastic contact piece 32 protrudes from the opening 28.

Next, the pair of spring members 24,24, as shown in FIG. 2, are engaged with the side walls 22*b*, 22*b* (as the connector housing 22 is symmetrical, only one side arrangement is illustrated). That is, the coiled portion 36 is engaged with the supporting shaft 29, and the first arm 37 abuts against an inside face of the first arm stopper 30. The second arm 38 deflects in the direction shown by arrow P to abut against an inner face of the second arm stopper 31, completing the mounting of the spring members 24 on the connector 21.

Then, the connector 21 is inserted into the connector receiving recess 26 in arrow Q direction shown in FIG. 2. At first, the reaction portions 39, 39 slidingly abut against the tapered portion 26*c*, so that the reaction portions 39, 39 are urged to move upward toward the first arm 37 until the lowest points of the reaction portions 39, 39 are positioned on a bottom wall 22*c* of the connector housing 22 as shown in FIG. 3. At the same time, the spring members 24, 24 resiliently abut against the lower wall 26*b* of the connector receiving recess 26.

The contact portion 35 of each elastic contact piece 32 slidably contacts the associated terminal connecting short strip 41 (see FIG. 1) to be resiliently depressed inward, so that the contact portion 35 resiliently abuts against the terminal connecting short strip 41 (see FIG. 1) with a suitable contact force (determined by the construction of the spring member 24 and the elastic contact piece 32) for electrical connection thereof.

Figure 8:
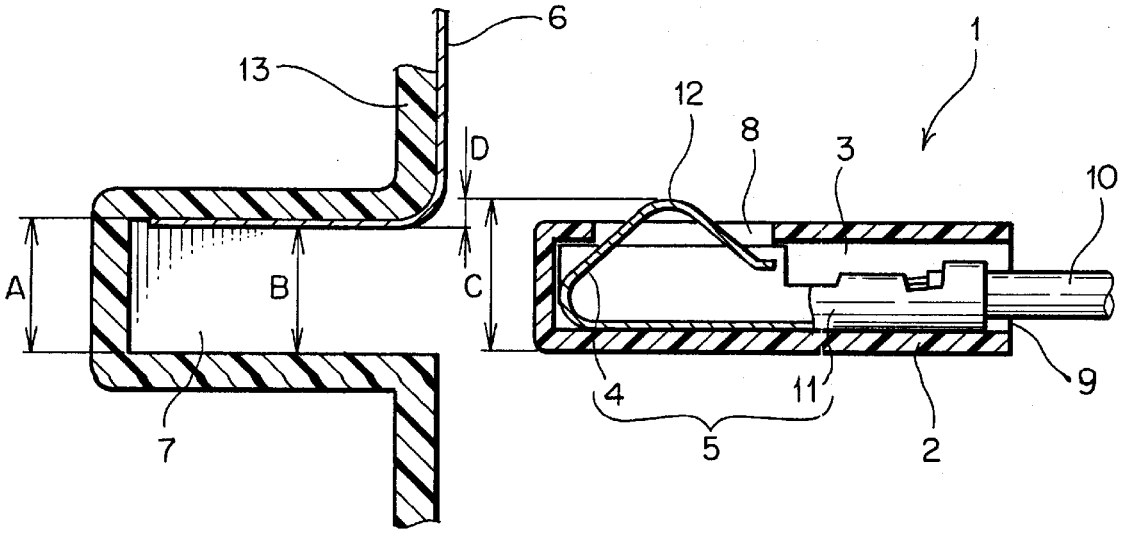
FIG. 8 PRIOR ART
FIG. 8 is a sectional view showing a prior-art connector.

Thus, even if there are variations in the distance between the walls 26*a*, 26*b* of the connector receiving recess 26 (corresponding to distance B discussed in FIG. 8) and in the height from the bottom wall 22*c* of the connector housing 22 to the contact portion 35 (corresponding to distance C discussed in FIG. 8), or even when the elastic contact piece 32 has yielded with time, the spring members 24,24 serve to keep an adequate contact force between the contact portion 35 and the terminal connecting short strip 41 (see FIG. 1).

Hence, the connector 21 discussed above can has a steady contact force to be a reliable one.

Figure 4:
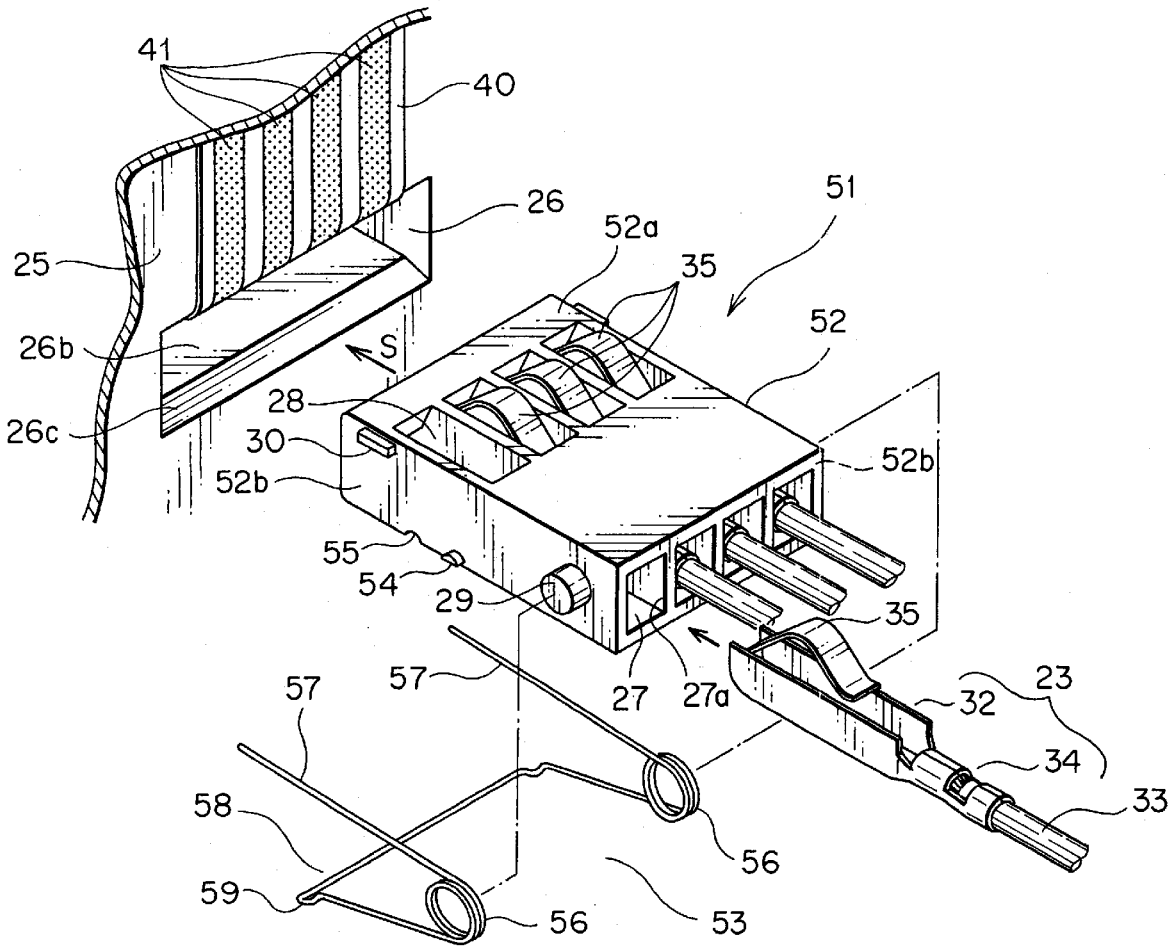
FIG. 4 is an exploded perspective view showing a connector of another embodiment of the present invention.
Figure 5:
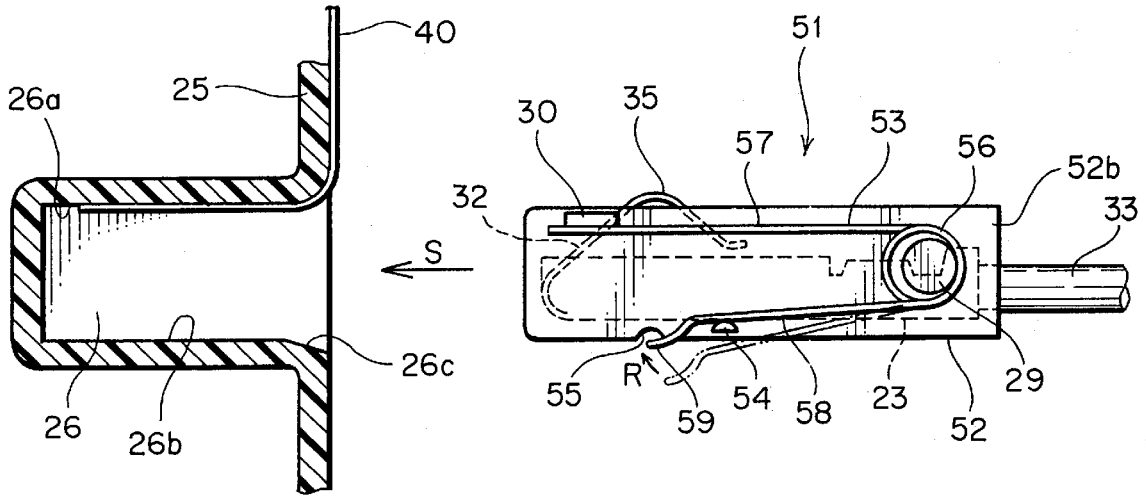
FIG. 5 is a side view of the connector shown in FIG. 4.
Figure 6:
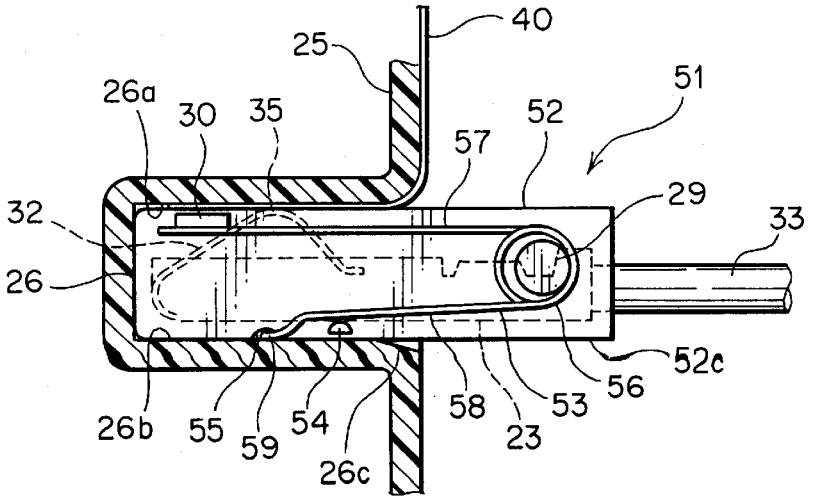
FIG. 6 is a side view showing the connector of FIG. 4 which has been inserted into the connector receiving recess.

Referring to FIGS. 4 to 6, another embodiment will be discussed, and the same numeral will be applied to the same component as used in the aforementioned connector 21.

In FIG. 4, a connector 51 has a connector housing 52 made of synthetic resin, a plurality (four in the embodiment) of terminals 23 inserted into the connector housing 52, and a spring member 53 held by the connector housing 52 (corresponding to the assisting means described in the summary of the invention). The connector 51 is inserted into a connector receiving recess 26 formed in an instrument case 25 for electrical connection thereof as well as the first embodiment.

The connector housing 52 has been formed in a rectangular shape by injection molding or the like and has four terminal accommodating chambers 27 therein. Each terminal accommodating chamber 27 has a terminal locking mean (not shown) like a lance. The connector housing 52 has a top wall 52*a* formed with four rectangular openings 28 each opposing to one of the terminal accommodating chambers 27.

The connector housing 52 has side walls 52*b*, 52*b* each provided with a column-shaped supporting shafts 29 at the rear side thereof. That is, the supporting shafts 29, 29 are laterally extending and located in the side of openings 27*a* of the terminal accommodating chambers 27. The side walls 52*b*, 52*b* also each have a rib-like arm stopper 30 and a rib-like cross over arm stopper 54 at the fore end side thereof. The arm stoppers 30, 54 (corresponding to the support means described in the summary of the invention and only one side stoppers are illustrated) are formed on each side wall 52*b* to align with opposite side ones. The connector housing 52 has a bottom wall 52*c* (see FIG. 6) having a concave, second cross over arm stopper 55.

The spring member 53 is made of a metal wire rod and has a pair of coiled portions 56, 56 each formed at an intermediate part thereof having an inside diameter engageable with the supporting shaft 29. From each coiled portion 56 is straightly extending an arm 57. The pair of coiled portions 56, 56 are connected by a U-shaped cross over arm 58. The arms 57, 57 and the cross over arm 58 move resiliently against each other by way of the coiled portions 56, 56. The cross over arm 58 has a reaction portion 59 extending laterally relative to the connector housing 52. The reaction portion 59 projects from the bottom wall 52*c* of the connector housing 52 to be engageable with the second cross over arm stopper 55 when the spring member 53 has been attached to the connector housing 52.

Referring to FIGS. 4 to 6, assembling steps of the connector 51 and an insertion step of the connector 51 into the connector receiving recess 26 will be discussed hereinafter.

As shown in FIG. 4, first, each terminal accommodating chamber 27 of the connector housing 52 receives one of the terminals 23. And, each received terminal 23 is locked by the terminal locking means (not shown), and the contact portion 35 of the elastic contact piece 32 is protruding from the opening 28.

Next, the spring member 53, as shown in FIG. 5, engages with the side walls 52*b*, 52*b* of the connector housing 52. That is, the coiled portions 56, 56 each receive one of the supporting shafts 29, 29, and the arms 57, 57 each abut against one of the arm stoppers 30, 30. The cross over arm 58 is urged in arrow R direction to abut against an inner face of each of the cross over arm stoppers 54, 54. However, the engagement of the spring member 53 may be made before the engagement of the cross over arm 58. The fitting steps complete the assembling of the connector 51.

Then, the connector 51 is inserted into the connector receiving recess 26 in arrow S direction as shown in FIG. 5. Thereby, the reaction portion 59 abuts against the tapered portion 26*c*, so that the reaction portion 59 moves upward toward the arms 57, 57 as shown in FIG. 6 to engage with the second cross over arm stopper 55. At the same time, the spring member 53 resiliently abuts against the lower wall 26*b* of the connector receiving recess 26.

Furthermore, the contact portion 35 of each elastic contact piece 32 slidingly abuts against one of the terminal connecting short strips 41 (see FIG. 4) to resiliently urge the elastic contact piece 32 inwardly so as to contact the terminal connecting short strip 41 with an adequate contact force (determined by the spring member 53 and the elastic contact piece 32) for electrical connection thereof.

Thus, even if there are variations as to the distance between the upper and lower walls 26*a*, 26*b* of the connector receiving recess 26 (corresponding to distance B discussed in FIG. 8) and as to the height from the bottom wall 52*c* of the connector housing 52 to the contact portion 35 (corresponding to distance C discussed in FIG. 8), or even when the elastic contact piece 32 has yielded with time, the spring member 53 serves to keep an adequate contact force between the contact portion 35 and the terminal connecting short strip 41 (see FIG. 4).

Hence, the connector 51 discussed above can have a steady contact force to be a reliable one as well as the connector 21.

Figure 7:
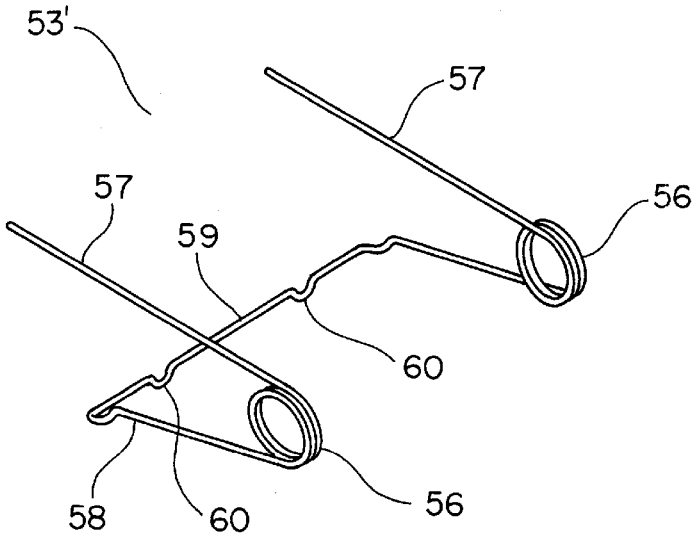
FIG. 7 is a perspective view showing another example of the spring member of FIG. 4.

In addition, the reaction portion 59 of the spring member 53 may have projections 60, 60 shown in FIG. 7 so that such a spring member 53' can receive well distributed reaction forces.

Moreover, the spring members 24, 53, and 53' requiring no electrical conductivity may be made of a more durable wire rod having a higher allowable stress and a higher yield stress. Thus, the spring member composing the assisting means allows the connector having a high reliability. Advantageously, the spring members can be easily formed.

Furthermore, the support means including the supporting shafts 29, 29 and the arm stoppers 30, 30 (shown in FIG. 1) can assist the elastic contact piece 32 in cooperation with the arm stoppers 31, 31. In addition, the location of the arm stoppers 30, 31 allows adjustment of the additional force of the spring member 24. The support means simple in design is easily assembled into the connector housing with a comparatively lower cost.

What is claimed is:

1. An electrical connector comprising:

a connector housing received on a connector receiving recess and having a plurality of terminal accommodating chambers, said connector receiving recess having a first wall fitted with a plurality of terminal connecting short strips, said connector housing having at least an opening communicating with said first wall of said connector receiving recess, a plurality of terminals being insertable into said terminal accommodating chambers, said terminals each having a wire connection portion and an elastic contact piece formed by folding back a forward part of said terminal, said elastic contact piece having a contact portion at the middle part thereof for contacting one of said terminal connecting short strips through said opening, an assisting means resiliently abutting against a second wall of said connector receiving recess for urging said elastic contact piece toward said first wall so that said contact portion resiliently abuts against said terminal connecting short strip, said second wall being opposed to the first wall, said assisting means having both a coiled portion formed by coiling an intermediate portion of a metal wire rod and a couple of arms being both end portions of the metal wire rod, said coiled portion engaging with said support means, one of said arms being a spring member having a reaction portion that abuts against the second wall of said connector receiving recess, and a support means formed on the connector housing and engaged with said assisting means to hold said assisting means.

2. The electrical connector as recited in claim 1, wherein said support means has both a supporting shaft engageable with said coiled portion and a couple of arm stoppers associated with said couple of arms.

3. The electrical connector as recited in claim 1, wherein said assisting means has a pair of coiled portions, a cross over arm positioned between said coiled portions, and first and second opposite arms extending respectively from the coiled portions, said pair of coiled portions each being each defined by coiling an intermediate part of a metal wire rod to engage with a pair of opposite portions of said the support means, said cross over arm being a spring member having a reaction portion abutting against said second wall of said connector receiving recess.

4. The electrical connector as recited in claim 3, wherein said reaction portion of said cross over arm has a projection facing said second wall of said connector receiving recess.

5. The electrical connector as recited in claim 3, wherein said support means has a pair of supporting shafts engageable with said pair of coiled portions, two arm stoppers respectively corresponding to said first and second opposite arms, and a cross over arm stopper corresponding to said cross over arm.

* * * * *